US005505368A

United States Patent [19]

Kanter et al.

[11] Patent Number: 5,505,368

[45] Date of Patent: Apr. 9, 1996

[54] CONTAINER ASSEMBLY AND METHOD OF MAKING THE SAME

[75] Inventors: Allen Kanter, Penllyn; James D. George, Hershey, both of Pa.

[73] Assignee: Hershey Foods Corporation, Hershey, Pa.

[21] Appl. No.: 229,387

[22] Filed: Apr. 18, 1994

[51] Int. Cl.[6] ..... B65D 5/32

[52] U.S. Cl. ..... 229/23 R; 229/23 BT; 229/120.11; 229/125.19; 493/102; 493/128

[58] Field of Search ..... 229/23 R, 23 BT, 229/120.11, 125.19; 220/416, 418; 493/84, 102, 128, 162, 295, 297, 298

[56] References Cited

U.S. PATENT DOCUMENTS

| | | | |
|---|---|---|---|
| 803,966 | 11/1905 | Barnes . | |
| 2,083,868 | 6/1937 | Rottman . | |
| 2,354,239 | 7/1944 | Williamson . | |
| 2,540,595 | 2/1951 | Props | 229/23 R |
| 2,675,123 | 4/1954 | Baird . | |
| 2,880,866 | 4/1959 | Van Dyke . | |
| 2,975,631 | 3/1961 | Hansen . | |
| 3,093,291 | 6/1963 | Brandle . | |
| 3,134,499 | 5/1964 | Johnson . | |
| 3,157,345 | 11/1964 | George | 229/23 BT |
| 3,301,457 | 1/1967 | Millian . | |
| 3,367,487 | 2/1968 | Dwyer . | |
| 3,371,844 | 3/1968 | Perrella . | |
| 3,499,068 | 3/1970 | Brown . | |
| 3,521,748 | 7/1970 | Layne . | |
| 3,642,193 | 2/1972 | Rada . | |
| 3,653,578 | 4/1972 | Wood . | |
| 3,670,946 | 6/1972 | Croley . | |
| 3,726,467 | 4/1973 | Shepherd . | |
| 3,850,362 | 11/1974 | Stollberg et al. . | |
| 3,880,341 | 4/1975 | Bamburg et al. | 229/23 R |
| 3,910,483 | 10/1975 | Ritter . | |
| 3,926,362 | 12/1975 | Beck et al. . | |
| 3,993,240 | 11/1976 | Matsuyama . | |
| 4,198,921 | 4/1980 | Horton . | |
| 4,342,416 | 4/1982 | Philips . | |
| 4,396,144 | 8/1983 | Gutierrez et al. . | |
| 4,440,307 | 4/1984 | Bartels et al. . | |
| 4,483,095 | 11/1984 | Webinger . | |
| 4,560,566 | 12/1985 | Roth . | |
| 4,572,425 | 2/1986 | Russell . | |
| 4,580,718 | 4/1986 | Muise | 229/23 R |
| 4,592,163 | 6/1986 | Wilson . | |
| 4,610,358 | 9/1986 | Walter . | |
| 4,624,382 | 11/1986 | Tontarelli . | |
| 4,655,366 | 4/1987 | Sykes . | |
| 4,691,859 | 9/1987 | Snyder | 229/23 R |
| 4,877,119 | 10/1989 | Hosking . | |
| 5,016,753 | 5/1991 | Henderson . | |

FOREIGN PATENT DOCUMENTS

| | | | |
|---|---|---|---|
| 3940872 | 6/1991 | Germany | 229/23 R |
| 986296 | 4/1964 | United Kingdom | 493/128 |

OTHER PUBLICATIONS

Large Federal Express Shipping Box, 139751 3/93 WC, as shown in attached photographs.

*Primary Examiner*—Gary E. Elkins
*Attorney, Agent, or Firm*—Gary A. Hecht

[57] ABSTRACT

A container preassembly which has an inner sleeve in a flat unopened position disposed within an outer sleeve in a flat unopened position. The two sleeves are adapted to form the two ends of the container and are secured together in the aligned relationship of the final open container, thereby allowing the preassembly to be opened into the form of the final container without requiring further adjustment. Once opened, the flaps for forming the container bottom are folded to create a container ready for use. A method of making the container preassembly is also provided.

22 Claims, 5 Drawing Sheets

CONTAINER ASSEMBLY AND METHOD OF MAKING THE SAME

BACKGROUND OF THE INVENTION

1. Field of the Invention

The present invention pertains to containers used for packaging, shipping, and displaying goods. More particularly, the invention relates to containers formed from at least two sections.

2. Description of the Related Art

Two piece containers are extremely popular and in widespread use. The present invention improves the two piece container to create one that is more useful and cost effective.

Typical two piece containers have separate top and bottom sections formed from separate blanks. A first section has side walls and flaps for forming the container's bottom. A second section has side walls and flaps for forming the top, and fits over the side walls of the bottom section to enclose the interior of the container. These top and bottom sections are sometimes referred to as half slotted containers since both are necessary to form a single fully enclosed container. In contrast, a regular slotted container is formed from a single blank section having both bottom and top forming flaps.

Two piece containers are extremely useful for packaging, storing, shipping, and displaying goods. After the goods are placed into the interior of the bottom section, the top section is placed over the bottom section to fully enclose the contents. The top and bottom sections can then be secured together for shipping.

Two piece containers are particularly useful as shipping-display containers. Used to package and ship goods for retail, the outside face of the bottom section can be printed and/or designed with promotional information suitable for display on the retail floor. The retailer simply removes the top section of the container and places the bottom display section containing the goods on the retail floor. Unlike regular slotted containers, no cutting or tearing of the container is required to open it. This type of container is very popular for food items which are easily displayed in the bottom display section.

One disadvantage of present two piece containers is the number of steps necessary to assemble the container. The user begins with the two separate container sections, both in a flat unfolded position. The bottom section is opened to form the sides and its flaps folded and secured to form the container bottom. The top piece is likewise opened and its flaps folded and secured to form the top. After the bottom section is loaded with the goods, the top section, slightly larger than the bottom, is placed over the bottom section to form a completely enclosed container. If desired, the two sections can be secured together.

Reducing the number of assembly steps would reduce the time and costs associated with using such containers. Moreover, simplifying the assembly steps would more readily allow automation.

Another problem associated with these containers is carpal tunnel syndrome. The hand motions necessary to assemble the containers are believed to increase the risk of carpal tunnel syndrome to the workers. Simplifying the assembly and use of the container while limiting the number of hand motions will help minimize the risk of carpal tunnel syndrome. Moreover, increasing the level of automation of the assembly and packaging can further reduce the number of hand motions, thereby lowering the risks of carpal tunnel syndrome.

Several different types of two section containers are known. None, however, address the problems identified. One such container, U.S. Pat. No. 5,016,753 to Henderson, teaches a telescoping packaging system using a two section container. This container expands and collapses to give the container a variable volume. The two container sections are initially temporarily secured together. The temporary securing means is then broken, and the two sections are then permanently secured together after expanding or collapsing the container to the desired volume. Rather than decreasing the steps necessary to assemble and use a container, this reference actually increases the number of steps. Moreover, such variable volume capability is not always necessary, nor is the assembly of such a container easily automated.

Accordingly, one object of the present invention is to provide a container and method of making and using the same that is simpler and more convenient.

Another object is to provide a container and method of assembling and using the same that is more cost effective.

A further object is to provide a container than can be assembled and used with automated equipment.

Another object of the present invention is to provide a container that requires less steps to assemble and use.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention provides an improved container and method for making the same that is simpler and more convenient to assemble and use. Broadly, the invention provides a container preassembly comprising an unopened outer sleeve, and an unopened inner sleeve positioned inside the outer sleeve. The inner and outer sleeves are secured together in an aligned relationship of the final opened container. Another embodiment, secures the two sleeves together using a releasable glue that does not destroy the surface of the inner sleeve when the two sleeves are eventually separated.

The invention also provides a method of making the container preassembly. The method provides a first blank and forms an inner sleeve from a second blank. The blank and inner sleeve are combined and the outer blank is folded around the inner sleeve. The ends of the outer blank are then secured to form an outer sleeve positioned around the inner sleeve.

BRIEF DESCRIPTION OF THE DRAWINGS

The foregoing summary, as well as the following detailed description, will be better understood when read in conjunction with the accompanying drawings. For the purpose of illustrating the invention, there is shown in the drawings a preferred embodiment. It is understood, however, that this invention is not limited to the precise arrangement shown.

DETAILED DESCRIPTION

The invention disclosed herein is a novel container and method of making and using the same. Described below is an embodiment particularly suited for containers used for shipping and displaying goods for retail. It is understood, however, that the present invention can be adapted to containers used for other purposes.

Figure 2:
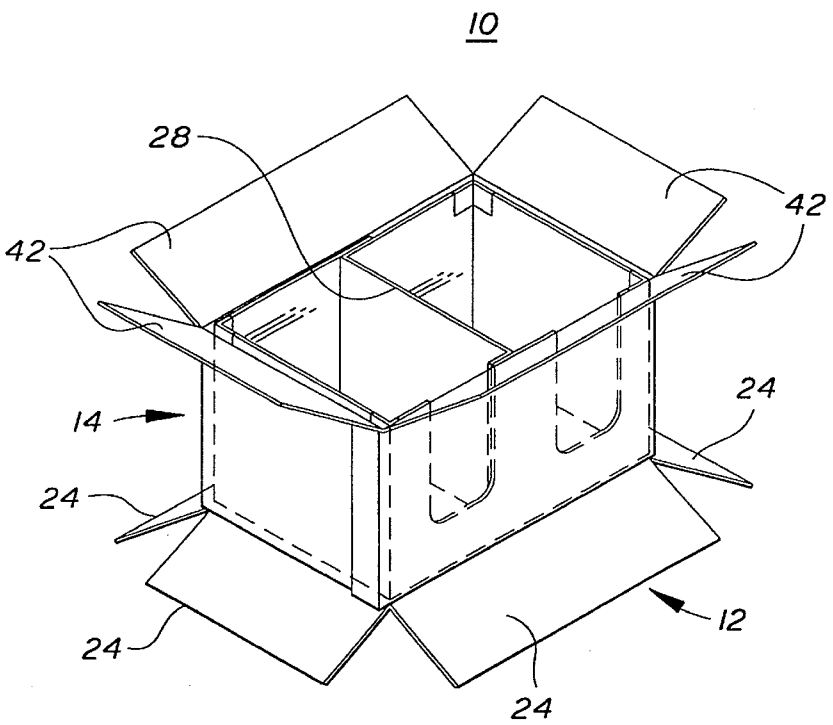
FIG. 2 is a perspective view of the container of FIG. 1 shown with the top and bottom flaps unfolded.
Figure 1:
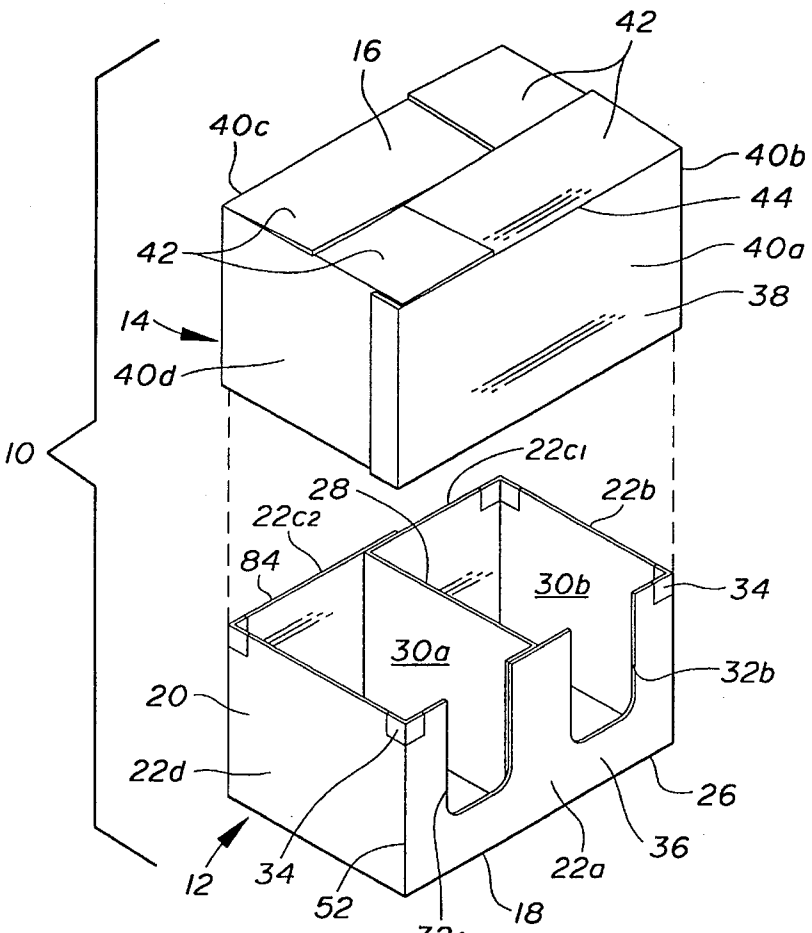
FIG. 1 is an exploded view of a container made in accordance with the present invention showing the outer and inner container sections.

Reference now will be made in detail to the presently preferred embodiment of the invention, examples of which are illustrated in the accompanying drawings. Illustrated in FIGS. 1 and 2 is a container 10 for shipping and displaying goods. The container 10 has an inner sleeve 12 adapted to fit within an outer sleeve 14. Sleeves 12 and 14 comprise the two sections that form the completed container 10 having a top 16 and a bottom 18. Each sleeve can be formed from a blank as further described below.

In the preferred embodiment, inner sleeve 12 comprises the bottom section of the container 10 as shown, and which is also used for displaying the goods once the outer section 14 is removed as shown in FIG. 1. The inner sleeve 12 has sides 20 comprised of side panels 22*a*, 22*b*, 22*c*1, 22*c*2, and 22*d*, (22*c*1 and 22*c*2 combine to form one side 20) and foldable flaps 24 for forming the bottom 18 of the container 10. It is readily seen that the bottom 18 is formed by folding the flaps 24 along the fold lines 26 between the side panels and the flaps 24. The fold lines indicate the line of fold to be made. As will be discussed further, the fold lines of the present embodiment preferably comprise score lines or creases impressed into the container material to aid folding, the terms being used interchangeably throughout this specification.

A divider panel 28 divides the interior of the container 10 into two sections 30*a* and 30*b*. Such bottom sections may be referred to as half slotted double quad sections and are useful for smaller goods that readily fit in each section 30*a*, 30*b*. For larger goods, a container without a divider wall 28 is provided. Display cutouts 32*a*, 32*b*, one for each section 30*a*, 30*b*, allow display of the goods within. Support tabs 34 can be pushed in to provide support for another container stacked on top once the outer sleeve 14 is removed.

When the inner sleeve 12 is to be used for displaying goods, its outer face 36 may be finished with suitable promotional information. For example, the outer face 36 may contain the name of the product and a promotional logo. A clear finish coating over the outer face 36, such as a MACOTE™ coating as supplied by Mid-Atlantic Packaging, Inc. of 436 Stump Road, Montgomeryville, Pa. 18936 can be applied to protect the promotional information and provide an aesthetically pleasing container section 12.

The outer section 14 has side walls 38 comprising side panels 40*a*, 40*b*, 40*c*, and 40*d*. The top 16 of the container 10 is formed by folding the flaps 42 along the fold lines (score line) 44.

As shown, the inner sleeve 12 is adapted to fit within the outer sleeve 14. When shipping goods, the outer sleeve 14 is preferably secured to the inner sleeve 12. Any suitable means for permanently securing the two sections together can be used, including adhesives such as glue. Other means include stitching, tape, etc. A suitable permanent securing means is one that is strong enough to hold the two sections of the completed container together during handling and shipping of goods. For a shipping-display type container as illustrated, it is preferable to use a permanent securing means that will not damage the finished outer face 36 of the inner sleeve 12 when the outer sleeve 14 is removed. One means of doing so is to use a releasable glue that is strong enough to allow the entire container to be carried by holding the outer section 14 without the inner section 12 falling out, but which allows the outer section 14 to be separated and removed from inner section 12 (breaking the glue joints between the two) without destroying the finished face 36. One such adhesive is #50-7054 as manufactured by United Resin Products of 239 Route 22, Greenbrook, N.J., 08812, and sold under the trademark "LOCK AND POP".

Figure 3:
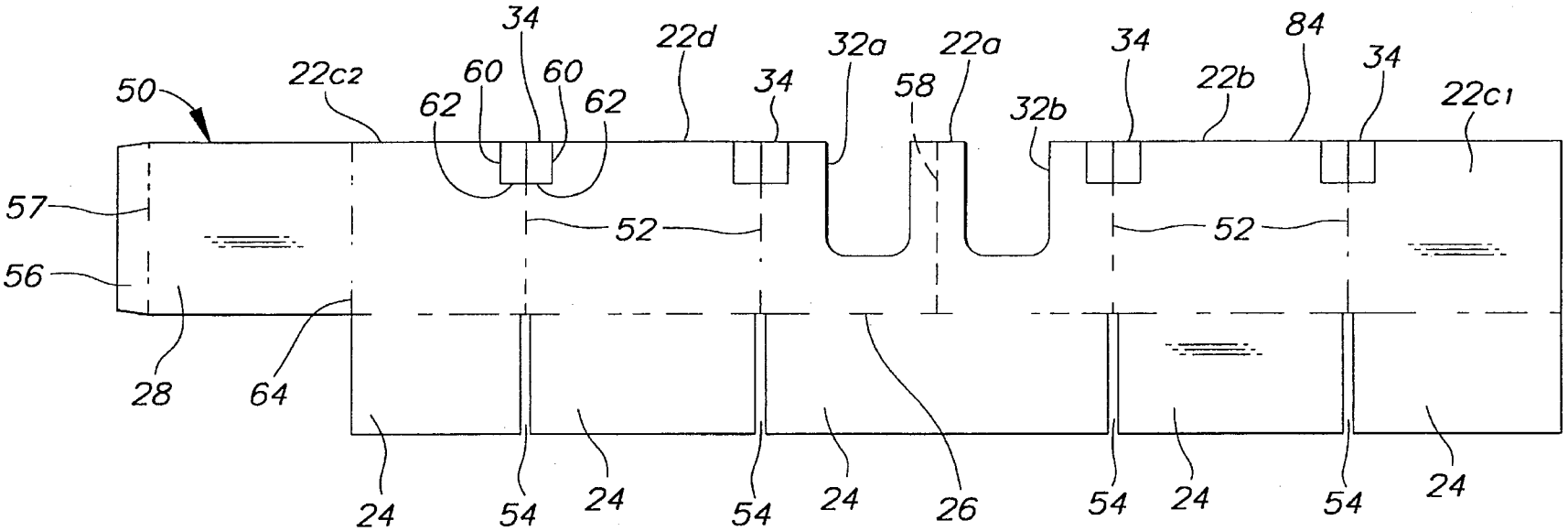
FIG. 3 is a plan view of a blank section for forming the inner section of the container in FIG. 1.
Figure 4:
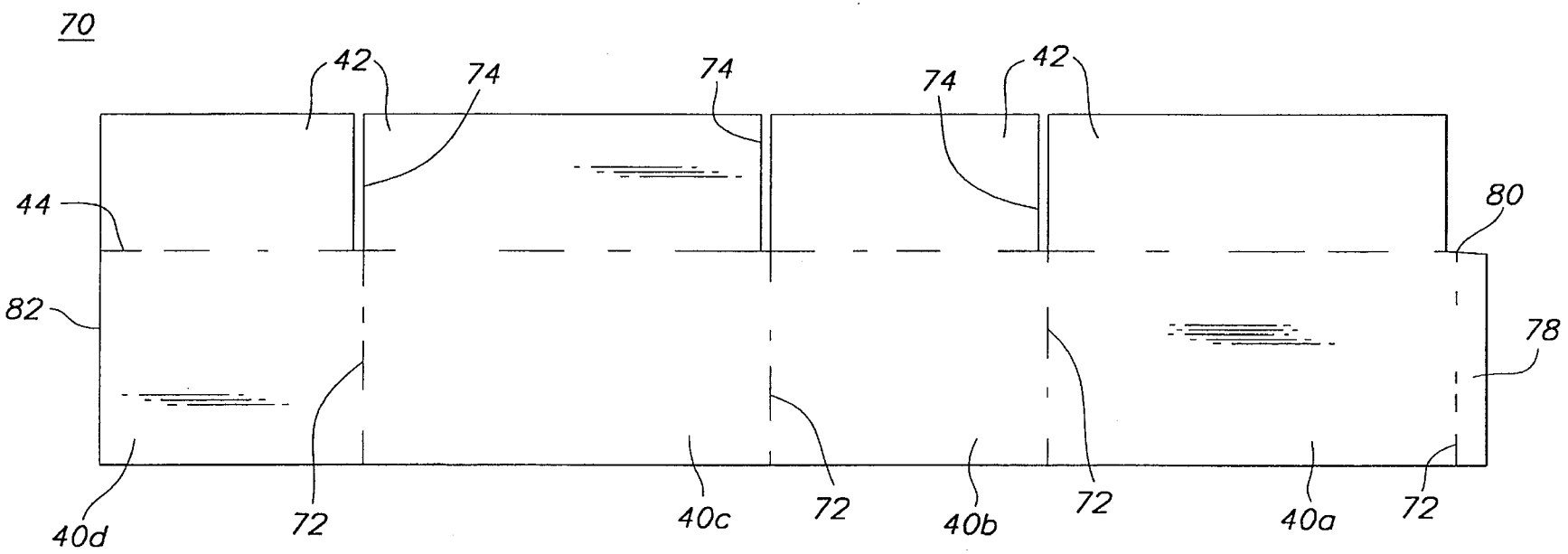
FIG. 4 is a plan view of the blank section for forming the outer section of the container in FIG. 1.

Having described the basic elements of the container 10, a method of making and using it is now described. Illustrated in FIGS. 3 and 4 are blanks from which the inner and outer sleeves 12 and 14 may be formed. The sleeves 12 and 14 can be formed from any material suitable for use as a container, including such materials as corrugated board and chipboard, a single piece of corrugated board being preferable for forming each sleeve of the illustrated embodiment.

Referring to FIG. 3, a blank 50 for forming the inner sleeve 12 has side panels 22*a*, 22*b*, 22*c*1, 22*c*2, and 22*d* for forming the sides 20 of container 10 (20*c*1 and 20*c*2 form one side). The panels can be separated by score lines (crease) 52 impressed into the blank 50 as shown to act as a fold line and aid in folding. Bottom forming flaps 24 are integrally connected to the side panels by score (fold) lines 26, and are separated from each other by slots 54. The cutouts 32*a*, 32*b* are provided on the front side panel 22*a* for displaying the goods within. The divider panel 28 separates the interior of the completed container 10 into the two sections 30*a*, 30*b*, and has a glue tab 56 having fold line 57 for attaching to the side panel 22*a* between the cutouts 32*a*, 32*b* along the imaginary line 58. Support tabs 34 are provided by score lines 60 and cut 62. The tabs are simply pushed in on the completed inner sleeve 12 to form a support.

It is seen that the inner sleeve 12 is formed by folding the blank 50 along the fold lines (score) 52 to form the inner sleeve sides 20. (It is recognized that the fold lines 52 form the side corners of the inner sleeve 12). Side panels 22*c*1 and 22*c*2 are secured together as shown in FIG. 1 to form the back side and to make the continuous sleeve 12. The divider panel 28 is folded along its fold (score) line 64, and its glue tab 56 secured to the side panel 22*a* at imaginary line 58. Any suitable means for securing the panels together may be used as is well known in the art, including adhesives such as glue.

Referring to FIG. 4, a blank 70 for forming the outer section 14 has the side panels 40*a*, 40*b*, 40*c*, 40*d* for forming the side walls 38. Fold lines comprising score lines 72 are impressed between the side panels to aid in folding the blank 70, and which form the side corners of the outer sleeve 14. The flaps 42 for forming the top 16 are separated by slots 74 and integrally attached to the side panels at a score line 44. A glue tab 78 is provided to secure the blank's one end 80 with the other end 82 when forming the continuous sleeve 14.

Once formed, the blanks 50, 70 can be combined to form a flat preassembled container that can be stored and shipped efficiently and which is easily erected into an open container for shipping goods. Illustrated in FIGS. 5, 6 and 7 is a preferred method of assembling and using the flat preassembled container.

Figure 5:
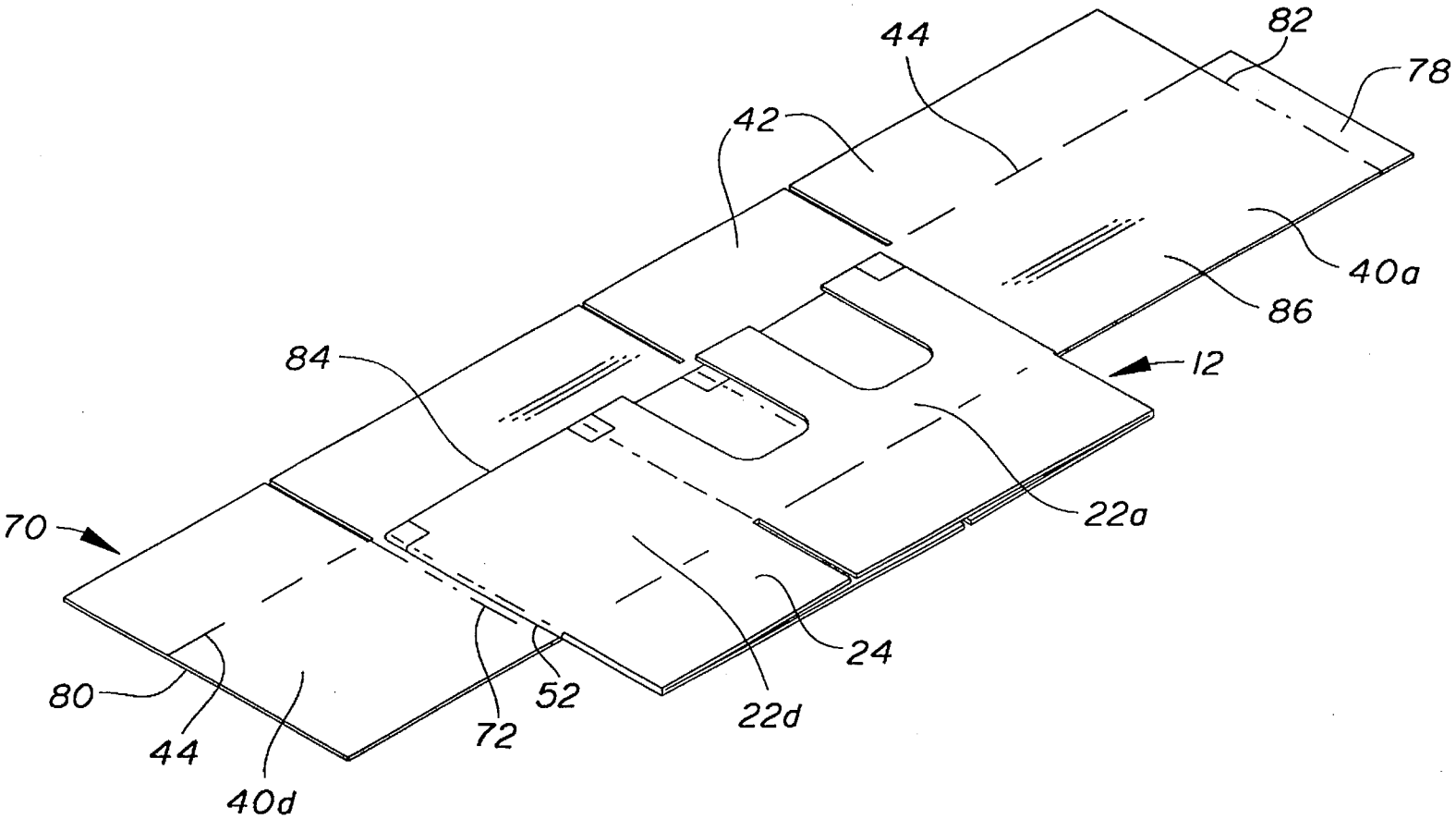
FIG. 5 is a perspective view showing an initial step of making the container of FIG. 1.

Referring first to FIG. 5, the outer blank 70 for forming the outer sleeve 14 is provided in a flat unfolded position. The inner sleeve 12 has been formed from the blank 50, and, as illustrated, is provided in a flat unopened form.

The inner sleeve 12 and the outer blank 70 are combined in the aligned position of the final opened container and secured together. As shown, the sleeve 12 and blank 70 are combined in the aligned relationship of the final erected (opened) container 10; i.e., the side panels of the inner sleeve 12 align with and are adjacent to the respective side panels of the outer blank 70 in the same relationship as the final container 10. Thus the front inner sleeve side panel 22*a* will align with the front outer sleeve side panel 40*a*, the back inner sleeve side panel 22*c*1, 22*c*2 will align with the back outer side panel 40*c*, etc. Moreover, the fold lines 52 of the inner sleeve 12 must align with the respective fold lines 72 of the outer sleeve 14 as these fold lines will form adjacent corners of the inner and outer sleeves of the final container 10, and must align to permit the two sleeves to open together as a single unit. The top edge 84 of the inner sleeve 12 should be secured to the blank aligned with or below the fold line 44 of the blank 70, otherwise the inner sleeve 12 will prevent the flaps 42 from being folded to form the top 16 of the final container 10 as shown in FIG. 1. Preferably, as illustrated, the top edge 84 of the inner sleeve 12 aligns with the score line 44 about which the flaps 42 of the outer sleeve fold to form the top 16 so that the top 16 of the final container 10 is positioned just above the edge 84, thereby providing additional support for the top 16.

Figure 6:
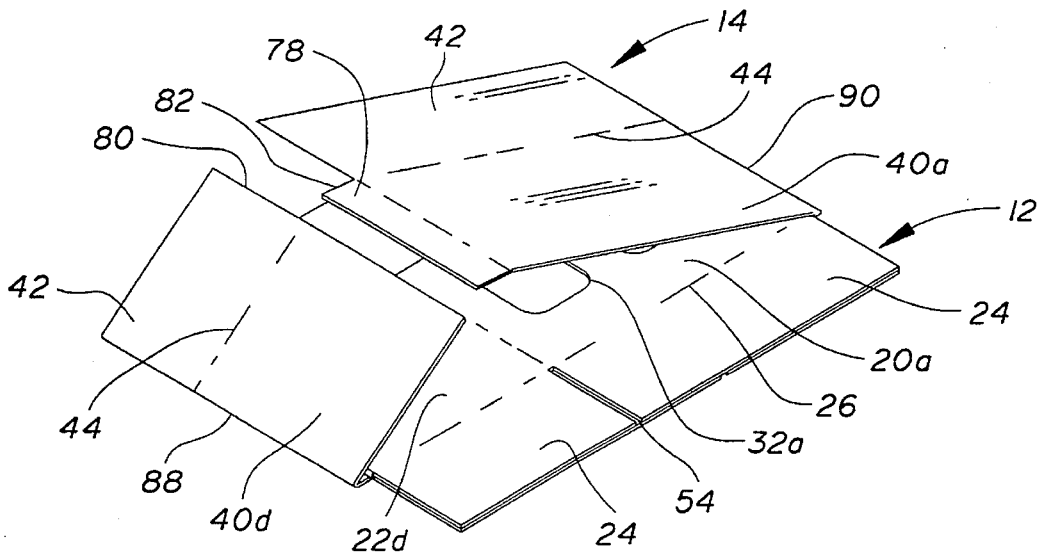
FIG. 6 is a perspective view showing another step of making the container of FIG. 1.
Figure 7:
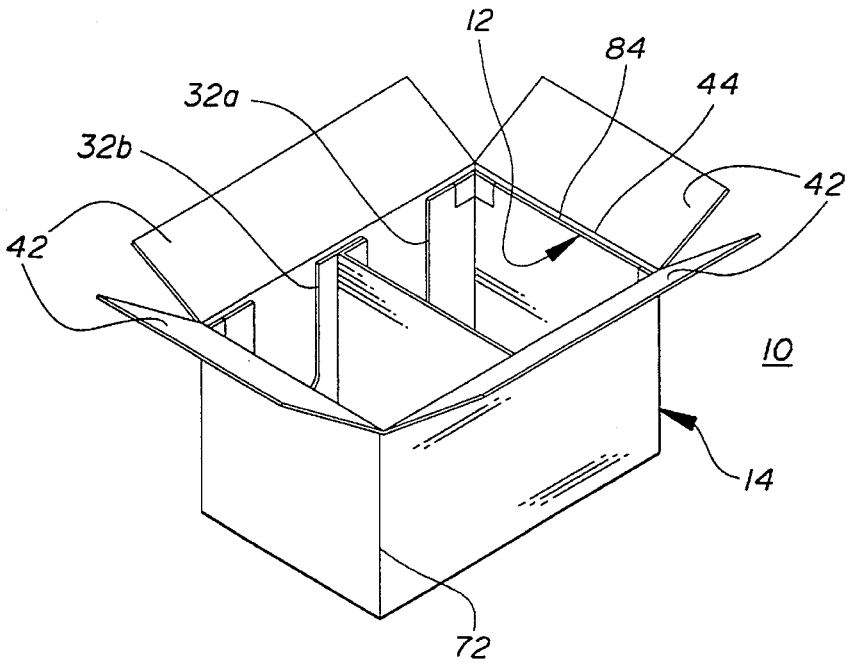
FIG. 7 is a perspective view showing a further step of making the container of FIG. 1.

Referring to FIG. 6, the blank 70 is then folded at two of the fold lines 72 around the inner sleeve 12. The ends 80, 82 of the blank are secured together using glue tab 78 to form the continuous outer sleeve 14 around and enclosing the inner sleeve 12.

The outer and inner sleeves are permanently secured together so that a completed container loaded with goods can be safely shipped and carried. For shipper-display type containers as illustrated, the securing means is preferably a releasable glue as previously described.

Although the means for securing the two sleeves together may be applied at any suitable time of assembly, adhesives such as glue are preferably applied to the inside face 86 of the outer blank 70 while it is in its unfolded form, as shown in FIG. 5, prior to being combined with the inner sleeve 12. For example, one method of doing so is to apply a suitable amount of glue drops to the inside face 86 of the side panels 40*a*, 40*b*, 40*c*, and 40*d*, then lay the inner sleeve 12 onto the blank 70 in the aligned position as described, and then fold the blank 70 around the inner sleeve 12.

Once the outer sleeve 14 is formed and secured around the inner sleeve 12, it is seen that a flat preassembled container comprising the unopened inner and outer sleeves 12, 14 is formed. Such flat assemblies are efficiently stored and shipped.

Using the container 10 is very simple and efficient. Referring to FIG. 6, the user erects the completed flat container preassembly by pushing the ends 88, 90 toward each other until an opened container 10 with the inner and outer sleeves 12, 14 secured together is formed as shown in FIG. 2. It is seen that this opens both sleeves as a single unit. The flaps 24 of the inner sleeve 12 are then folded and secured to form the container bottom 18, thereby forming a container 10 ready to be loaded with goods as shown in FIG. 7. Once loaded with goods, the flaps 42 of the outer section 14 are folded and secured to form the top 16, thereby enclosing the goods within the container 10.

The present invention thereby provides a flat container preassembly which is simple and efficient to make, and which is easily erected into a completed container. Because forming the flat container preassembly as well as erecting and loading the fully formed container requires a few simple steps, the assembly and use of the container can be readily automated.

While a particular embodiment of the invention is described herein, it is not intended to limit the invention to such disclosure. Changes and modifications may be incorporated and embodied within the scope of the appended claims. For example, the illustrated embodiment shows the inner sleeve having flaps for forming the container bottom. Those skilled in the art readily recognize that the inner sleeve could be made to form the top of the container, or that the container could be positioned on its side for side loading.

Those skilled in the art will also recognize that the present invention is not limited to the blanks illustrated. Other types of blanks may include self locking flaps for forming both top and bottom, and may include fold line means between the panels other than scored lines.

Furthermore, the present invention is not limited to rectangular containers. Any suitably shaped container, having inner and outer sleeves can incorporate the invention, including, but not limited to, hexagonal and pentagonal shaped containers.

What is claimed is:

1. A container preassembly for opening into a container having top and bottom ends, comprising:

an unopened outer sleeve having panels for forming outer sleeve sides, and flaps integrally connected to said panels for forming one end of the container;

an unopened inner sleeve positioned inside said outer sleeve, said inner sleeve having panels for forming inner sleeve sides and flaps integrally connected to said panels for forming the other end of the container; and said outer and inner sleeves are secured together in an aligned relationship of the opened container.

2. A container preassembly in accordance with claim 1 wherein said outer and inner sleeves are secured together with a permanent adhesive.

3. A container preassembly in accordance with claim 2 wherein said adhesive is a releasable glue.

4. A container preassembly in accordance with claim 1 wherein said inner and outer sleeves are in a flat unopened position.

5. A container preassembly in accordance with claim 2 wherein said inner and outer sleeves are in a flat unopened position.

6. A container preassembly in accordance with claim 1 wherein said outer and inner sleeves are further aligned such that a top edge of said inner sleeve aligns with a fold line of said outer sleeve located between said end forming flaps and said panels of said outer sleeve.

7. A container preassembly in accordance with claim 6 wherein said sleeves are secured together with a releasable glue.

8. A container preassembly in accordance with claim 6 wherein said inner and outer sleeves are in a flat unopened position.

9. A container preassembly in accordance with claim 1 wherein said inner and outer sleeves are adapted to open into a rectangular shaped container.

10. A container preassembly adapted to open into a container having top and bottom ends, comprising:

an outer sleeve in a flat unopened position, said outer sleeve having panels for forming sides, and flaps for forming one end of the opened container;

an inner sleeve in a flat unopened position, said inner sleeve having panels for forming sides, and flaps for forming the other end of the opened container;

said outer and inner sleeves permanently secured together in an aligned relationship of the container when opened such that corner forming fold lines separating the said side panels of said inner sleeve align with corner forming fold lines separating said side panels of said outer sleeve.

11. A container preassembly in accordance with claim 10 wherein a releasable glue permanently secures said inner and outer sleeves together.

12. A container preassembly in accordance with claim 11 wherein said outer and inner sleeves are further aligned such that a top edge of said inner sleeve aligns with a fold line of said outer sleeve between said end forming flaps and said panels of said outer sleeve.

13. A method of making a container comprising the steps of:

(a) providing an outer blank, said outer blank having a first end and a second end and panels for forming sides;

(b) forming an inner sleeve from a second blank having panels for forming sides;

(c) combining said outer blank and said inner sleeve;

(d) folding said outer blank around said inner sleeve; and (e) securing said first and second ends of said outer blank to form an outer sleeve positioned around said inner sleeve.

14. A method of making a container in accordance with claim 13 further comprising the step of securing said outer sleeve to said inner sleeve.

15. A method of making a container in accordance with claim 14 wherein said outer and inner sleeves are secured together in an aligned relationship such that corner forming fold lines separating said panels of said inner sleeve align with respective corner forming fold lines separating said panels of said outer sleeve.

16. A method of making a container in accordance with claim 15 wherein said inner and outer sleeves are secured with an adhesive.

17. A method of making a container in accordance with claim 16 wherein step (c) is carried out by laying said inner sleeve on an inside face of said outer blank, and wherein said adhesive is applied to said inside face prior to said sleeves being combined.

18. A method of making a container in accordance with claim 14 wherein said step of securing said outer sleeve to said inner sleeve is carried out by applying a permanent adhesive.

19. A method of making a container in accordance with claim 14 wherein said step of securing said outer sleeve to said inner sleeve is carried out by applying a releasable glue.

20. A method of making a container in accordance with claim 15 wherein said inner sleeve is provided in a flat unopened position, and said outer blank is folded around said flat unopened inner sleeve to form a flat unopened outer sleeve.

21. A method of making a two section container preassembly having inner and outer sections, comprising the steps of:

(a) providing an outer blank for forming the first section, said outer blank provided in a flat position and having a first end and a second end, said outer blank having panels for forming sides and flaps integrally connected to said flaps for forming a container top;

(b) providing an inner sleeve in a flat position for forming the second section, said inner sleeve having panels for forming sides, and a flap integrally connected to said panels of said inner sleeve for forming a container bottom;

(c) combining said outer blank with said inner sleeve in an aligned relationship such that corner forming fold lines separating said panels of said first section align with respective said corner forming fold lines separating said panels of said second section;

(d) folding said outer blank around said inner sleeve and joining said first and second ends of said outer blank to form an outer sleeve around said inner sleeve; and (e) permanently securing said outer sleeve to said inner sleeve.

22. A method of making a container preassembly in accordance with claim 21 wherein a releasable adhesive is used to permanently secure said sleeves together.

* * * * *